US006168346B1

(12) United States Patent
Ernsberger

(10) Patent No.: US 6,168,346 B1
(45) Date of Patent: Jan. 2, 2001

(54) SPACER FOR SUPPORTING A GUARD RAIL ON A POST

(76) Inventor: Ronald E. Ernsberger, 5 Park La., Napolean, OH (US) 43545

( * ) Notice: Under 35 U.S.C. 154(b), the term of this patent shall be extended for 0 days.

(21) Appl. No.: 09/115,789

(22) Filed: Jul. 14, 1998

Related U.S. Application Data

(60) Provisional application No. 60/052,444, filed on Jul. 14, 1997.

(51) Int. Cl.[7] ..... E01F 13/00; E01F 15/00

(52) U.S. Cl. ..... 404/6; 404/9; 256/13.1

(58) Field of Search ..... 404/6, 9; 256/13.1, 256/66

(56) References Cited

U.S. PATENT DOCUMENTS

| | | | |
|---|---|---|---|
| 2,603,455 | 7/1952 | Welch . | |
| 2,701,127 | 2/1955 | Elliot . | |
| 3,317,189 | 5/1967 | Rubenstein . | |
| 3,493,213 | 2/1970 | Ackerman | 404/6 |
| 3,591,144 | 7/1971 | Iving . | |
| 3,603,562 | 9/1971 | Glaesener . | |
| 3,704,861 | 12/1972 | Glaesener . | |
| 3,784,167 | 1/1974 | Glaesener . | |
| 3,825,218 | 6/1976 | Glaesner . | |
| 3,825,229 | 7/1974 | Bartlett et al. | 256/13.1 |
| 3,963,218 | 6/1976 | Glaesener . | |
| 4,047,701 | 9/1977 | Glaesener . | |
| 4,090,694 | 5/1978 | Vincent . | |
| 4,138,093 | 2/1979 | Meinzer . | |
| 4,312,600 | 1/1982 | Schaaf et al. . | |
| 4,406,563 | 9/1983 | Urlberger . | |
| 4,684,107 | 8/1987 | Robbins, Jr. . | |
| 4,739,971 | 4/1988 | Ruane . | |
| 5,152,507 | 10/1992 | Lee . | |
| 5,195,727 | 3/1993 | Liao et al. . | |
| 5,203,543 * | 4/1993 | Fleury | 256/13.1 |
| 5,219,241 * | 6/1993 | Picton | 404/6 |
| 5,261,647 | 11/1993 | Venegas, Jr. et al. . | |
| 5,284,236 | 2/1994 | Ohta et al. . | |
| 5,336,016 | 8/1994 | Baatz . | |
| 5,429,449 | 7/1995 | Baatz . | |
| 5,503,496 | 4/1996 | Voigt . | |
| 5,507,473 * | 4/1996 | Hammer et al. | 256/13.1 |
| 5,791,811 * | 8/1998 | Yoshino | 404/6 |
| 6,007,269 * | 11/1996 | Marinelli | 404/6 |
| 6,010,275 * | 4/1993 | Fitch | 404/6 |

* cited by examiner

*Primary Examiner*—Eileen D. Lillis
*Assistant Examiner*—Raymond W. Addie
(74) *Attorney, Agent, or Firm*—McMillan, Sobanski & Todd, LLC

(57) ABSTRACT

A spacer for supporting a horizontally extending guard rail on a vertically extending post in a roadway safety barrier system includes a first portion that is secured to the guard rail and a second portion that is secured to the post. The first and second portions are shaped to correspond with the shapes of the guard rail and the post secured thereto. For example, if the guard rail is formed having an undulating cross sectional shape, the first portion of the space is formed having a corresponding undulating cross sectional shape. One or more bores are formed through the spacer between said first and second faces for receiving a bolt for securing the guard rail and the post to the spacer. The spacer is formed from a thermoplastic material that is recyclable, will not absorb water, stable under the ultraviolet and other radiation generated by the sun, will not splinter, crack, or delaminate in use, and is more cost effective than conventional wooden spacers.

14 Claims, 1 Drawing Sheet

SPACER FOR SUPPORTING A GUARD RAIL ON A POST

CROSS REFERENCE TO RELATED APPLICATION

This application claims the benefit of U.S. Provisional Application Ser. No. 60/052,444, filed Jul. 14, 1997.

BACKGROUND OF THE INVENTION

This invention relates in general to roadway safety barriers and in particular to an improved structure for a spacer for supporting a horizontally extending guard rail on a vertically extending post.

Safety barriers are commonly provided along roadways to prevent or reduce the severity of vehicular accidents. When an operator loses control of a vehicle, the vehicle may tend to veer off the road. The safety barrier blocks the path of a veering vehicle and restrains it from leaving the roadway. Many safety barriers are designed to deforms upon impact to absorb energy and slow the moving vehicle.

A typical roadway safety barrier includes a plurality of horizontal guard rails that are supported on a plurality of vertical posts. The posts are spaced apart along the side of the roadway and are fixed in place, typically by extending into the ground. A spacer is often provided to support the guard rails on the posts. In the past, spacers of this type have been manufactured from wood, typically treated (wolmanized, for example) lumber. Despite such treatment, it has been found that such wooden spacers deteriorate as a result of continuous exposure to ambient weather conditions. The wooden spacers are also relatively expensive to fabricate and somewhat unfriendly to the environment. Thus, it would be desirable to provide an improved structure for a guard rail spacer that is long lasting, re-usable, and more cost effective than current wooden spacers.

SUMMARY OF THE INVENTION

This invention relates to an improved structure for a spacer for supporting a horizontally extending guard rail on a vertically extending post in a roadway safety barrier system. The spacer includes a first portion that is secured to the guard rail and a second portion that is secured to the post. The first and second portions are shaped to correspond with the shapes of the guard rail and the post secured thereto. For example, if the guard rail is formed having an undulating cross sectional shape, the first portion of the space is formed having a corresponding undulating cross sectional shape. One or more bores are formed through the spacer between said first and second faces for receiving a bolt for securing the guard rail and the post to the spacer. The spacer is formed from a thermoplastic material that is recyclable, will not absorb water, stable under the ultraviolet and other radiation generated by the sun, will not splinter, crack, or delaminate in use, and is more cost effective than conventional wooden spacers.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
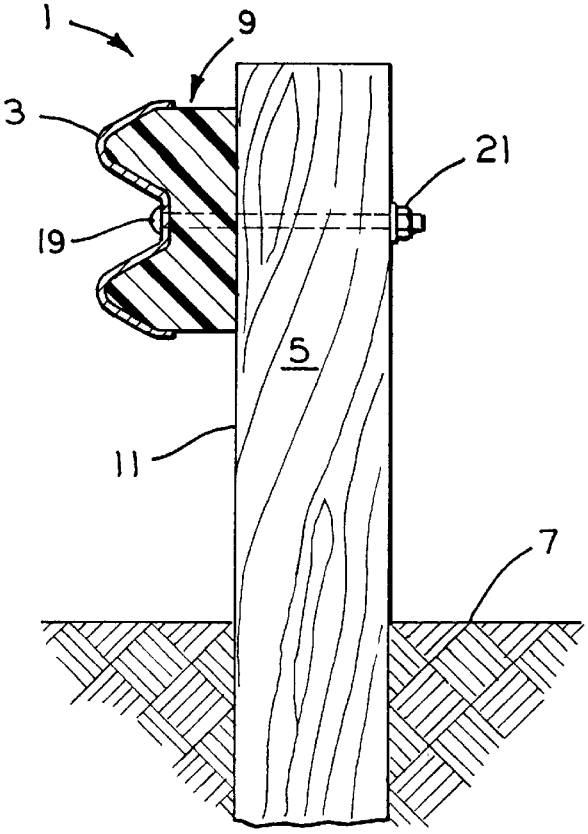
FIG. 1 is sectional elevational view of a portion of a roadway safety barrier system including a horizontally extending guard rail, a vertically extending post, and a spacer in accordance with this invention for supporting the guard rail on the post.

Referring now to the drawings, there is illustrated in FIG. 1 a portion of a roadway safety barrier system, indicated generally at 1, including a horizontally extending guard rail 3 that is supported on a vertical post 5. As is well known, the roadway safety barrier system 1 is composed of a plurality of such guard rails 3 that are supported on a plurality of such posts 5. To accomplish this, a spacer, indicated generally at 9, is disposed between the each of the guard rails 3 and each of the posts 5 to support the guard rails 3 thereon. The structure of the spacer 9 will be explained in detail below.

The guard rail 3 is typically formed from a flat elongated piece of material, such as sheet metal, although other materials may be used. Typically, the metallic guard rail 3 is corrugated to form an undulating cross section, such as shown in FIG. 1. The illustrated guard rail 3 is corrugated to absorb energy from an impact from a vehicle. When a vehicle collides against the safety barrier system 1 at a relatively low force, the corrugated guard rail 3 will deflect the vehicle without permanently deforming and, thus, will not require subsequent repair. When a vehicle collides against the safety barrier system 1 at a greater force, the corrugated guard rail 3 will deform and absorb the vehicle's kinetic energy to slow the vehicle. The guard rail 3 may, however, be formed having any desired shape.

The posts 5 are spaced apart along the edge of the roadway and fixed in place, typically by extending into respective holes formed in the ground 7. The inherent stiffness of the corrugated guard rail 3 allows the posts 5 to be spaced farther apart along the roadway than would otherwise be possible. The posts 5 support the guard rail 3 and transfer the energy of a vehicle impact to the ground 7. The posts 5 are usually square or rectangular in cross sectional shape, having four flat sides 11. However, the posts 5 may be formed having any desired shape, including cylindrical. The posts 5 are typically manufactured from wood, such as wolmanized lumber that is treated for increased weather resistance. However, the posts 5 may be manufactured from any desired material.

Figure 2:
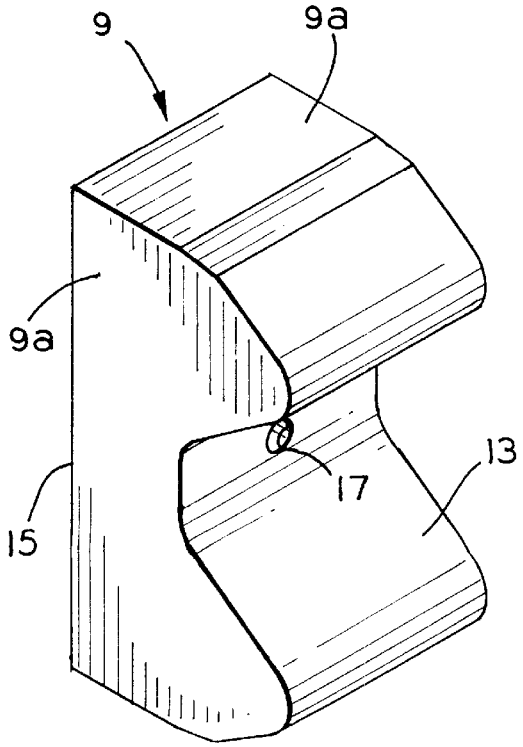
FIG. 2 is a front perspective view of the guard rail spacer illustrated in FIG. 1.
Figure 3:
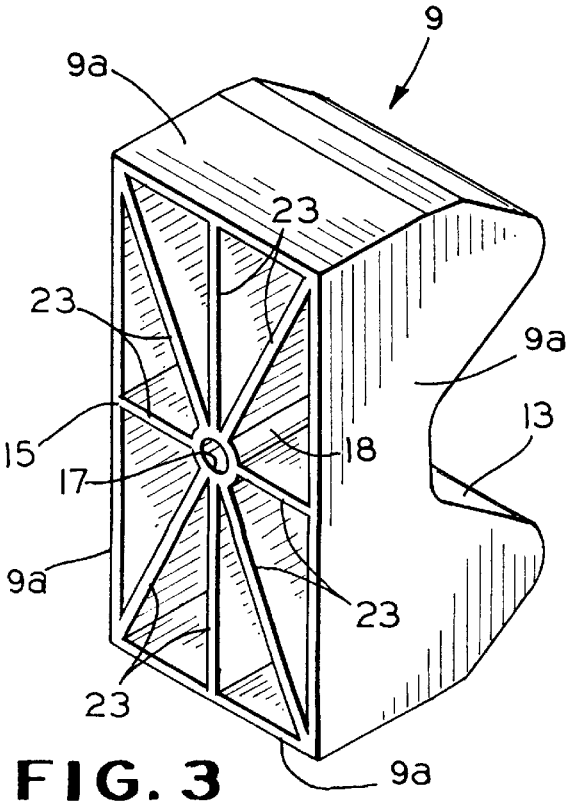
FIG. 3 is a rear perspective view of the guard rail spacer illustrated in FIG. 1.

The spacer 9 is provided between each of the posts 5 and its associated guard rail 3 to support the guard rail 3 thereon. As best shown in FIGS. 2 and 3, the spacer 9 includes a body having a first face 13 that preferably corresponds generally in shape with the cross sectional shape of the guard rail 3. Thus, the first face 13 of the illustrated spacer 9 is formed having an undulating cross sectional shape that follows the undulating cross sectional shape of the guard rail 3. These complementary shapes provide for a relatively large contact surface between the first face 13 of the spacer 9 and the associated guard rail 3. Similarly, the spacer 9 has a second face 15 that preferably corresponds generally in shape with the cross sectional shape of the outer surface 11 of the post 5. Thus, the second face 15 of the illustrated spacer 9 is formed having a flat cross sectional shape. These complementary shapes provide for a relatively large contact surface between the second face 15 of the spacer 9 and the associated post 5. It will be appreciated that the faces 13 and 15 of the spacer 9 need not precisely conform with the cross sectional shapes of the guard rail 3 and the post 5.

The spacer 9 is formed or molded from a virgin, recycled, or reclaimed thermoplastic material, such as high density polyethylene, which is heat formed and cut to the desired size. The spacer 9 may be formed from a solid piece of material if desired. However, it is preferable that the spacer 9 be formed from a hollow piece of material. As best shown in FIG. 3, the spacer 9 has four side walls 9a which extend laterally between the first face 13 and the second face 15. The spacer 9 may have one or more support ribs 23 formed in the interior thereof which extend inwardly from the side walls 9*a* thereof to provide structural support. Preferably, a central support 18 is provided in the central portion of the spacer 9, extending from the first face 13 to the second face 15. The support ribs 23 may extend inwardly from the side walls 9*a* of the spacer 9 to the central support 18, as best shown in FIG. 3. A bore 17 may be formed through the central support 18 extending from the first face 13 of the spacer 9 to the second face 15. The bore 17 is provided to accommodate a threaded fastener, such as a bolt 19 (see FIG. 1) that extends through the guard rail 3, the spacer 9, and the post 5 into cooperation with a nut 21 to secure the guard rail 3 to the post 5. In this manner, or in any other conventional manner, the guard rail 3 is secured to the spacer 9 and the post 5.

The thermoplastic spacer 9 is advantageous over current wood spacers for several reasons. First, the thermoplastic spacer 9 of this invention is environmentally-friendly in that it can be completely recycled if damaged or deformed. Thus, the thermoplastic spacer 9 of this invention need not be disposed of in a landfill or other waste collection area. Also, the thermoplastic spacer 9 of this invention eliminates the need for tree-cutting because it is not formed from wood. Second, the thermoplastic spacer 9 of this invention will not absorb water, thus eliminating the need for water treatments, such as creosote or wolmanizing, conventionally used with wood spacers. Third, the thermoplastic spacer 9 of this invention is stable under the ultraviolet and other radiation generated by the sun. Fourth, unlike conventional wood spacers, the thermoplastic spacer 9 of this invention will not splinter, crack, or delaminate in use. On the contrary, the thermoplastic spacer 9 of this invention is weather resistant and long lasting. Lastly, the thermoplastic spacer 9 of this invention is more cost effective than current wood spacers.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A roadway safety barrier system comprising:

a post formed from a first material;

a guard rail; and a spacer secured to said guard rail and said post, said spacer being formed from a second material different from said first material, said second material comprising a thermoplastic material.

2. The roadway safety barrier system defined in claim 1 wherein said spacer includes a body having a first face engaged with said guard rail and a second face engaged with said post.

3. The roadway safety barrier system defined in claim 2 wherein said body has a bore formed therethrough that extends from said first face to said second face.

4. The roadway safety barrier system defined in claim 3 further including a threaded fastener that extends through said bore and secures said guard rail and said post to said spacer.

5. The roadway safety barrier system defined in claim 2 wherein said body is generally hollow, having a plurality of side walls that extend from said first face to said second face.

6. The roadway safety barrier system defined in claim 5 wherein said hollow body has a central support formed therein that extends from said first face to said second face.

7. The roadway safety barrier system defined in claim 6 wherein said central support has a bore formed therethrough that extends between said first face and said second face.

8. The roadway safety barrier system defined in claim 7 further including a threaded fastener that extends through said bore and secures said guard rail and said post to said spacer.

9. The roadway safety barrier system defined in claim 6 wherein said hollow body has a support rib formed therein that extends from one of said plurality of side walls to said central support.

10. The roadway safety barrier system defined in claim 6 wherein said hollow body has a plurality of support ribs formed therein that extend from said plurality of side walls to said central support.

11. The roadway safety barrier system defined in claim 1 wherein said body is formed from high density polyethylene.

12. The roadway safety barrier system defined in claim 2 wherein said guard rail is formed having an undulating shape, and wherein said first face of said body is formed having a corresponding undulating shape.

13. The roadway safety barrier system defined in claim 2 wherein said post is formed having a flat shape, and wherein said second face of said body is formed having a corresponding flat shape.

14. The roadway safety barrier system defined in claim 2 wherein said guard rail is formed having an undulating shape and said first face of said body is formed having a corresponding undulating shape, and wherein said post is formed having a flat shape, and wherein said second face of said body is formed having a corresponding flat shape.

* * * * *